United States Patent [19]

Eheim

[11] 4,407,245

[45] Oct. 4, 1983

[54] SHUTOFF APPARATUS FOR FUEL INJECTION PUMPS

[75] Inventor: Franz Eheim, Stuttgart, Fed. Rep. of Germany

[73] Assignee: Robert Bosch GmbH, Stuttgart, Fed. Rep. of Germany

[21] Appl. No.: 294,077

[22] Filed: Aug. 19, 1981

[30] Foreign Application Priority Data

Sep. 20, 1980 [DE] Fed. Rep. of Germany ..... 3034605

[51] Int. Cl.[3] ..... F02D 31/00

[52] U.S. Cl. ..... 123/359; 123/458; 123/198 DB

[58] Field of Search ..... 123/359, 458, 459, 514, 123/198 DB

[56] References Cited

U.S. PATENT DOCUMENTS

| | | | |
|---|---|---|---|
| 1,664,608 | 4/1928 | French | 123/458 |
| 3,661,130 | 5/1972 | Eheim | 123/359 |
| 3,779,225 | 12/1973 | Watson et al. | 123/458 |
| 3,851,635 | 12/1974 | Murtin et al. | 123/458 |
| 3,896,779 | 7/1975 | Omori et al. | 123/458 |
| 4,036,193 | 7/1977 | Kobayashi et al. | 123/357 |
| 4,083,346 | 4/1978 | Eheim | 123/198 DB |
| 4,343,280 | 8/1982 | Luscomb | 123/458 |

*Primary Examiner*—Ira S. Lazarus
*Assistant Examiner*—Magdalen Moy
*Attorney, Agent, or Firm*—Edwin E. Greigg

[57] ABSTRACT

A shutoff apparatus for distributor injection pumps in internal combustion engines is proposed. The apparatus may also be used as a means of overspeed protection, and under the effect of an electromagnetic pushing magnet it opens the high-pressure chamber of the injection pump in order to shut off the engine. The opening of the high-pressure chamber is effected without the use of a valve subjected to the injection pressure, by means of the axial displacement of a pressure-equalized annular cylinder, which causes a relief bore to come into coincidence with the high-pressure chamber. The displacement of the annular cylinder is effected under the pressing action of an electromagnet. The area of the high-pressure chamber located opposite the distributor piston is sealed off by a slidable plug, which is prestressed by spring force and is centered via the annular cylinder by the distributor piston. The actuation push rod of the electromagnet acts in the direction along this slidable plug and it may in part replace this element.

4 Claims, 7 Drawing Figures

SHUTOFF APPARATUS FOR FUEL INJECTION PUMPS

BACKGROUND OF THE INVENTION

The invention is based on a shutoff apparatus or safety means for preventing excess revolutions in fuel injection pumps as defined hereinafter. A safety means to prevent such overspeeding in injection pumps in internal combustion engines is known from DE-AS 19 13 808. In this apparatus, the high-pressure chamber is defined on one end by the pump piston, which executes the conventional stroke comprising reciprocating and rotational movements, and on the other end by the closing body of a safety valve, which is magnetically actuatable. Supplying an appropriate current to the coil of the electromagnet keeps the safety valve closed; the valve is opened whenever an exciting current for the electromagnet is attained such that threshold safety means in the control circuit of the electromagnet respond and break the current circuit. The exciter current attained at this instant corresponds to the maximum permissible rpm. In this known safety means for preventing excess rotation, the disadvantage is that the safety valve is exposed directly to the injection pressure, and the dropping of the electromagnet is not capable of automatically effecting an immediate opening of the safety valve. This opening is effected by a separate spring, which responds as soon as the injection pressure has dropped in the high-pressure portion of the pump.

A fuel injection pump is also known from German Design Pat. No. 1,890,843, in which the pump piston executing the reciprocating movements is surrounded in its upper portion by a cylindrical slide which has a relief bore leading to a return-flow line. The relief bore is opened at a predetermined instant during the compression stroke executed by the pump piston; the pressure in the pump work chamber or high-pressure chamber thereupon drops, because the fuel continuing to be displaced is capable of flowing back to the tank. The cylindrical slide is pressed by a prestressing spring against an upper stop and communicates at its other end, via a bore, with the portion of the inlet conduit located ahead of the throttle slide. When the inlet pressures are very high, the result in this case is that the pump work chamber is opened earlier.

There is a need for an electric shutoff apparatus for a distributor injection pump in internal combustion engines, especially 8-cylinder engines, which is not overly sensitive and which necessitates only small magnetic forces.

OBJECT AND SUMMARY OF THE INVENTION

The shutoff apparatus according to the invention has the advantage that all the surfaces exposed to the injection pressure are completely pressure-equalized so that only small magnetic forces are required to effect the opening of the high-pressure chamber which in turn effects the shutoff of the engine. It is furthermore particularly advantageous that there is no valve in the vicinity of the high-pressure chamber intended for opening this chamber, which means that there is also no valve seat which would be vulnerable to soiling. Since the element or ring cylinder which effects the opening of the high-pressure chamber is pressure-equalized in accordance with the invention, great reliability in operation is attained as well as unimpaired response on the part of the electromagnet generating the displacement path, since none of the parts of this electromagnet is exposed to the effects of high pressure.

As a result of the characteristics disclosed hereinafter, advantageous further embodiments and improvements of the shutoff apparatus disclosed in the main claim can be attained. It is particularly advantageous when the shutoff apparatus according to the invention is also used as a safety means for preventing overspeeding; a current is then fed to the electromagnet such that the magnet attracts upon the attainment of a pre-set threshold rpm. Alternatively, in a different embodiment, the exciter current which is responsible for the excitation of the electromagnet may be switched off upon attaining the threshold rpm. In this case, because the magnetic forces are small, it is possible to attain a particularly sensitive and reliable shutoff function precisely in the field of overspeed prevention; if the rpm once again falls below the threshold rpm, this shutoff function can be cancelled immediately.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
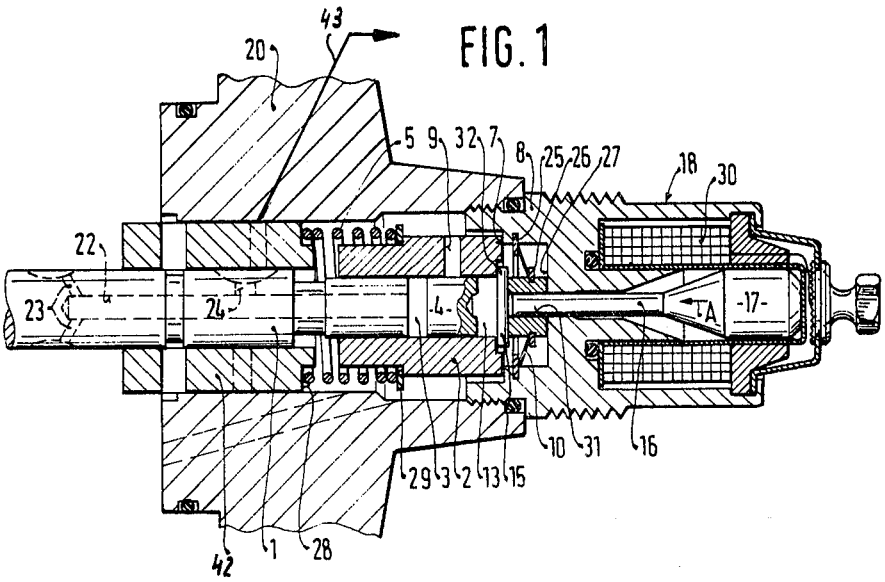
FIG. 1 shows a first exemplary embodiment of an electromagnetic shutoff apparatus for a distributor injection pump in cross section.
Figure 2:
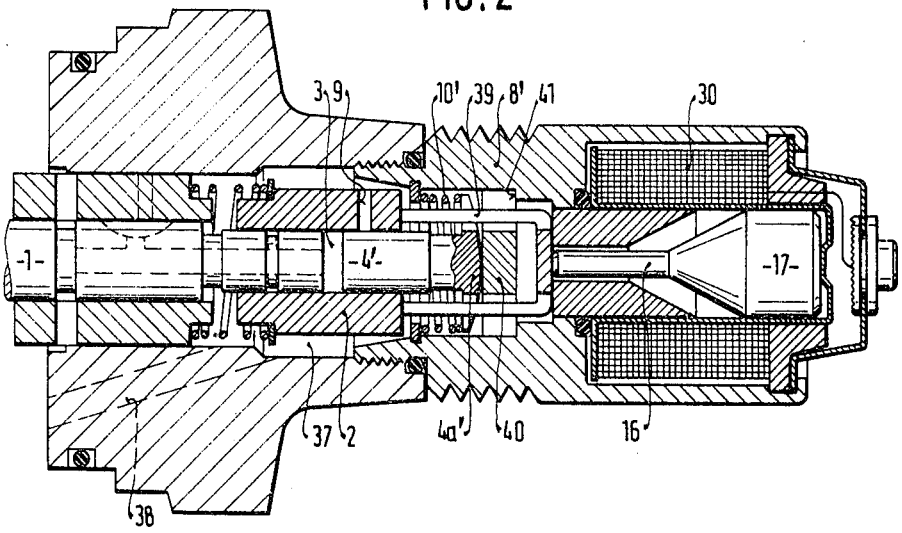
FIGS. 2 and 2*a* illustrate one structural variant of the first exemplary embodiment.
Figure 3:
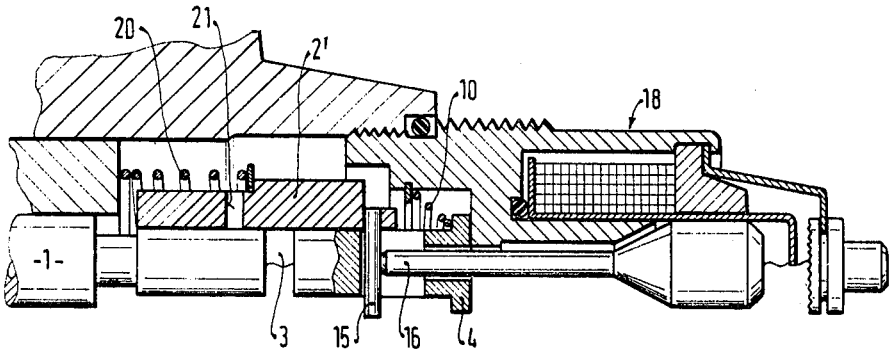
FIGS. 3 and 3*a*, again in sectional form, each illustrate one form of embodiment in which the shutoff takes place when the electromagnet has no current running through it.

In FIG. 1, there is a housing 20 of a distributor injection pump; the housing is shown only schematically and in part. A pump cylinder 42 is pressed into the housing and the pump piston or distributor piston 1 is guided within this pump cylinder 42. The design and form of embodiment of the distributor piston 1 and of the components surrounding it, including the bore and the like, may be embodied in a manner known per se and thus arbitrarily to suit the actual injection procedure. In any event, the distributor piston 1 has an axial through bore 22, which discharges into the pump work chamber, element chamber or high-pressure chamber 3 in the upper end section shown in the drawing on the right. Arbitrary transverse bores 23, 24 proceed laterally from the axial bore 22, acting as inlet bores for the fuel to be supplied or as outlet control bores which deliver the fuel to the injection nozzles, not shown, via a pressure line 43 which is shown purely schematically. The distributor injection pump shown in FIGS. 1, 2 and 3 is preferably an injection system associated with an 8-cylinder internal combustion engine; the invention has to do with the part of this system which, by arbitrarily opening the high-pressure chamber 3 of the injection pump, effects the shutoff of the engine. In terms of the actual injection procedure, it must then merely be noted that the pump piston 1 may execute a reciprocating movement in the conventional manner, for instance under the control of a cam disc which may roll off on rollers and translates the rotational movement of a drive shaft into corresponding reciprocating movements as well.

An element cylinder or annular cylinder 2 is slidably and displaceably disposed on the distributor piston 1. The high-pressure chamber 3 is sealed off at the top by a plug 4, which is held stationary. The plug 4 also serves to guide the annular cylinder 2. The plug 4, in turn, is supported in an arbitrary manner and is held in the housing 20 or in the pump cylinder 42 or, as shown in FIG. 1, in a further magnet housing with the aid of a spring 10 in the position shown in FIG. 1. The magnet housing 8 represents one part of the distributor injection pump and is secured by way of example on the housing 20. It serves the purpose of displacing the annular cylinder 2, as described below. In order to support the plug 4 on the magnet housing 8, the spring 10 may be embodied as a plate spring, which is supported at one end on an annular collar 25 of the magnet housing 8 and on the other end on a corresponding annular collar or securing ring 26 on the plug 4, accordingly pressing the plug 4 axially against an annular shoulder 27 of the magnet housing and securing it radially as well. The plug 4 is therefore held in its position both by the hydraulic pressure prevailing in the high-pressure chamber 3 and by the spring 10; as a result, it is assured that the annular cylinder 2 is supported in a pressure-equalized manner and is pressed upward against a further shoulder 7 of the magnet housing 8 solely by a spring 5. The spring 5 is supported at one end on an annular collar 28 of the pump cylinder 42 and at the other end on an annular collar or a securing ring 29 on the annular cylinder 2.

Figure 1A:
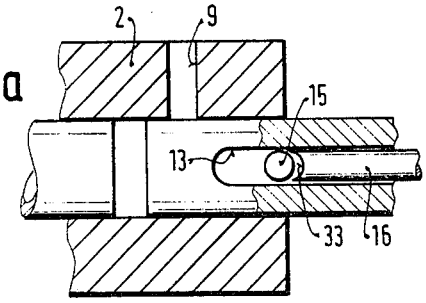
FIG. 1*a* is an enlarged, partial section showing the disposition of the push rod of the magnet armature in the plug which closes the high-pressure chamber.

The magnet housing 8 receives a magnetic switching apparatus which in the illustrated exemplary embodiment is embodied as a pushing magnet 18 having a magnetic winding 30 and armature 17. When an electric voltage is supplied to the pushing magnet, the magnet draws its armature 17 in the direction of the arrow A, so that an armature push rod 16 undergoes a displacement in the direction toward the distributor piston 1. The rod 16 connected with the armature 17 of the pushing magnet is guided within a bore 31 of the plug 4, the bore merging in the vicinity of a crosspiece or transverse pin 15 with an oblong slot 13. The oblong slot 13, as shown in the detail illustration of FIG. 1*a*, is open at either end toward the outside in order to guide the transverse pin 15. The transverse pin 15 is therefore displaceably disposed such that it is subject to the action of the push rod or shank 16; it is supported at one end at 32 on an offset shoulder of the annular cylinder, and on the other end in a corresponding recess 33 of the bolt 16.

The mode of operation which results is thus as follows: in the normal operating position, the annular cylinder 2 or element cylinder is held in the illustrated position by the spring 5. In this position, the transverse or relief bore 9 is closed with respect to the high-pressure chamber 3; that is, it is covered by the wall of the plug 4. The high-pressure chamber 3 is accordingly tight, and the pump effects injection in a normal fashion.

In order to effect shutoff, or upon attaining a predetermined threshold rpm, a voltage is then applied via an electric switching apparatus, not shown, to the winding 30 of the pushing magnet; as a result, the armature 17 attracts, and the bolt 16 and the transverse pin 15 are both displaced toward the left as shown in the drawing. The transverse pin 15, in so doing, also draws the annular cylinder 2 toward the left, as a result of which the relief bore 9 opens the high pressure chamber 3 so that the latter is relieved of pressure, precluding injection. The engine then stops; or, if there is only a temporary triggering of the pushing magnet 18 at high rpm (attainment of the threshold rpm), a normal shutdown is effected, until the rpm has again dropped below the threshold rpm.

Figure 1B:
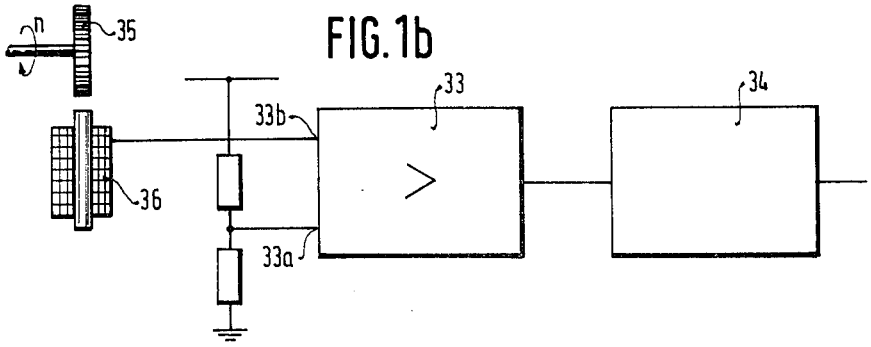
FIG. 1*b* shows the possible form of embodiment of an electrical circuit which evaluates an rpm signal in order to trigger the shutoff apparatus according to the invention, if this shutoff apparatus is to be used as a means of overspeed protection.

Circuits which, in an internal combustion engine upon attaining a predetermined threshold rpm, generate a voltage sufficient for triggering the pushing magnet 18 in the illustrated exemplary embodiment are known per se. By way of example, as shown in FIG. 1*b*, they may have an amplifier (operational amplifier 33), the first input 33*a* of which is supplied with a constant comparison voltage and the other input 33*b* of which is supplied with a voltage which increases as the rpm increases. The operational amplifier 33 then switches through whenever the constant comparison voltage corresponding to the threshold rpm has been attained at its other input. A power amplifier 34 may also be switched subsequent to the operational amplifier 33. The voltage which increases constantly with the increasing rpm may be obtained, by way of example, with the aid of a rotating ferromagnetic toothed element which acts upon a yoke carrying at least one induction winding, so that an electrical rpm signal is generated in this winding. The toothed element is shown as 35 in FIG. 1*b* and the yoke having the induction winding is shown as 36. The pulses induced in the induction winding may be summed up, or the voltage amplitude which intensifies with increasing rpm may be evaluated in analog fashion and utilized for triggering the pushing magnet.

Figure 3A:
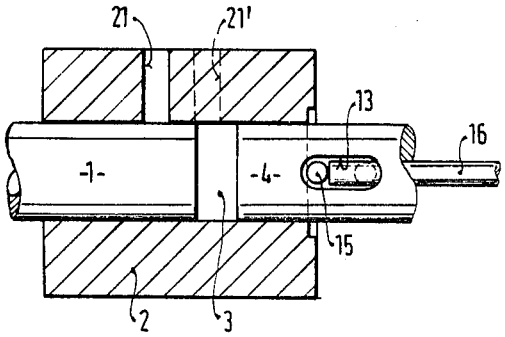

If the shutoff is intended to occur when the magnet has no current running through it, as is shown in more detail in FIGS. 3 and 3*a*, then it is necessary merely to dispose an inverter for triggering the magnet subsequent to the amplifier chain 33, 34, or to design the operational amplifier 33 in such a way that its output signal tends to zero potential when the threshold rpm has been attained (exchanging the input terminals of the reference voltage and the control voltage).

Figure 2A:
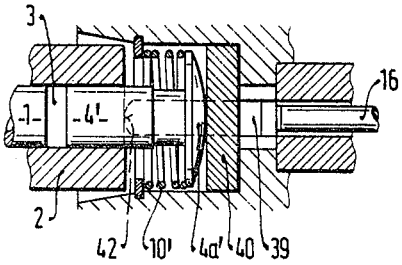

The form of embodiment shown in FIGS. 2 and 2*a* is a structural variant in which the pushing magnet is likewise switched on only in order to shut off the engine. The actuation of the annular cylinder 2 with its relief bore 9—which furthermore opens out into a free annular chamber 37 having an oblique bore 38 and a return means to the pump suction chamber, not shown—is effected in this form of embodiment via a yoke-like U-shaped bracket 39, which is driven by the push rod or bolt 16 of the magnet armature 17. In this exemplary embodiment, the annular cylinder 2 is again pressure-equalized, and it is displaceably supported on both the distributor piston 1 and the plug 4'. The plug 4' is positioned axially by its contact against an additional plate 40 in such a manner that the plug 4' is capable of being freely centered in the magnet housing 8', which is shown here as being elongated. The plate 40 is seated compactly in an offset shoulder 41 of the magnet housing 8'. An upper mushroom-shaped enlargement 4*a'* of the plug 4' rests against this bearing plate 40, the enlargement 4*a'* extending upward in a slightly rounded fashion, so that the final centering of the plug 4' is effected by the distributor piston 1 via the annular cylinder 2. Both the bearing plate 40 and the mushroom head 4a' of the plug 4' are pierced by the bifurcated shanks of the actuation bracket 39, which is guided through appropriate lateral openings in the bearing plate 40 and the mushroom head 4a'. As shown in FIG. 2a at reference numeral 42, the shank ends are also rounded and rest at either side on the upper annular face of the annular cylinder 2. Here, as well, the plug 4' is pressed upward, against the bearing plate 40, by means of a spring 10'; the spring is supported at an inner collar of the magnet housing 8' and outward on the mushroom head 4a'. Upon activation of the switching magnet, the magnet attracts its armature 17, and the annular cylinder 2, via the push rod 16 and bracket 39, undergoes a displacement toward the left in the drawing, so that the relief bore 9 comes into close contact with the high-pressure chamber 3 and opens it, so that in consequence the engine is shut off and in any event the injection procedure is interrupted.

It will also be recognized that, as noted above in connection with the electric block circuit diagram of FIG. 1b, the shutoff may also be effected with a current-free magnet, or more specifically a magnet which is becoming free of electric current. This may have the advantage that if there is a malfunction in the supply of electricity, such as an interruption or the like, damage is prevented because in this case the injection of fuel is always interrupted. This form of embodiment is accordingly particularly well suited for providing overspeed protection.

In the form of embodiment shown in FIGS. 3 and 3a, which is fundamentally similar to that of FIG. 1 having the transverse pin 15 and the plug 4 pierced centrally by the armature bolt 16 and having the oblong slot 13, the relief bore 21 is therefore located in the annular cylinder 2' below the high-pressure chamber 3, or as seen in the drawing in FIG. 3, to the left of the high-pressure chamber 3. The pushing magnet 18 is permanently switched on and presses the annular cylinder 2' into the position shown in the drawing, counter to the action of a prestressing spring 20. In this position, the relief bore 21 is always reliably located below the high-pressure chamber 3. The spring 20 is thus tensed, and the diversion bore 21 is closed. In order to effect shutoff or the prevent overspeeding, the circuit of electrical current to the pushing magnet is interrupted; the spring 20 thereupon displaces the annular or element cylinder 2' toward the right, and the relief bore 21 comes into the vicinity of the high-pressure chamber 3 as indicated in FIG. 3a at reference numeral 21', thus opening the high-pressure chamber 3. The injection is then interrupted, and the engine is shut off.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A shutoff apparatus and/or overspeeding protection means for fuel injection pumps of internal combustion engines, said pump comprising a high-pressure portion connected with a low-pressure portion via an electromagnetically actuatable control device, a high pressure chamber controlled by a distribution piston and a displaceably supported annular cylinder, an electromagnet having a housing, said electromagnet including actuation means arranged to engage said annular cylinder and axially aligned with said distribution piston, means slidably supported in said annular cylinder to seal said high-pressure chamber, said means slidably supported in said annular cylinder being arranged to be urged by a spring means against a stop on said housing, said annular cylinder including an axial bore which intersects a lateral means defining a slot, a pin in said slot arranged to engage said annular cylinder, said actuation means arranged to contact said pin, and said annular cylinder being normally held against a stop means by a compression spring, a normally closed relief bore in said annular cylinder located above said high-pressure chamber.

2. An apparatus as defined by claim 1, wherein said means slidably supported in said annular cylinder is provided with a mushroom-like head and urged by spring pressure against a bearing plate which abuts said electromagnet housing, and wherein said actuation means arranged to engage said annular cylinder further includes a bifurcated member which penetrates both said bearing plate and said mushroom-like head.

3. An apparatus as defined by claim 1, wherein said relief bore of said annular cylinder is disposed in such a manner that the high-pressure chamber is closed relative thereto when said electromagnet is permanently switched on, and when said electromagnet is inoperative, the pre-stressing said compression spring displaces said relief bore in said annular cylinder into the vicintiy of said high-pressure chamber.

4. An apparatus as defined by claim 1, characterized in that said electromagnet is influenced by a switching signal in such a manner that the activation and deactivation of the electromagnet occurs whenever a pre-determined threshold rpm of the engine has been attained, whereby engine overspeeding is prevented.

* * * * *